United States Patent [19]

Osmera et al.

[11] Patent Number: 4,542,998

[45] Date of Patent: Sep. 24, 1985

[54] CHARACTER SET PRINTING MEANS UTILIZING ROLLING PRESSURE CONTACT FOR PRINTING

[75] Inventors: Miroslav S. Osmera; Van-Minh Huynh; Trevor A. Calnek, all of Waterloo, Canada

[73] Assignee: NCR Corporation, Dayton, Ohio

[21] Appl. No.: 528,029

[22] Filed: Aug. 31, 1983

[51] Int. Cl.[4] ..... B41J 1/20

[52] U.S. Cl. ..... 400/139; 400/146; 400/152; 400/153; 400/154.2; 400/158; 400/162.1; 400/162.3; 400/234; 400/424; 400/635; 400/654; 101/111

[58] Field of Search ..... 400/139, 140, 141, 141.1, 400/142, 144, 144.1, 145, 145.1, 145.2, 146, 147, 148, 152, 153, 154.2, 154.4, 154.5, 155, 158, 158.1, 162.1, 162.3, 163, 163.1, 234, 424, 635, 654, 655; 101/93.13, 93.18, 111

[56] References Cited

U.S. PATENT DOCUMENTS

| | | | |
|---|---|---|---|
| 3,045,796 | 7/1962 | Scribner | 400/145 |
| 3,144,820 | 8/1964 | Wales, Jr. | 400/153 X |
| 3,309,987 | 3/1967 | Pexton | 101/79 |
| 3,381,790 | 5/1968 | Chaveneaud et al. | 400/139 |
| 3,537,563 | 11/1970 | Stantchev | 400/148 |
| 3,661,076 | 5/1972 | Berger et al. | 101/93.13 |
| 3,684,076 | 8/1972 | Crain et al. | 400/635 X |
| 3,743,073 | 7/1973 | Perez | 400/163 |
| 3,831,731 | 8/1974 | Mack et al. | 400/154.2 X |
| 3,884,338 | 5/1975 | Koller | 400/146 X |
| 3,983,804 | 11/1976 | Thienemann | 400/146 X |
| 4,077,318 | 3/1978 | Tamai | 101/37 |
| 4,078,485 | 3/1978 | Guthrie | 400/154.4 X |
| 4,146,337 | 3/1979 | Li | 400/174 X |
| 4,191,104 | 3/1980 | Okabe | 400/146 X |
| 4,226,180 | 10/1980 | Matsui | 400/146 X |
| 4,313,681 | 2/1982 | Lendl et al. | 400/144.2 |

FOREIGN PATENT DOCUMENTS

| | | | |
|---|---|---|---|
| 53022 | 8/1890 | Fed. Rep. of Germany . | |
| 1611489 | 4/1971 | Fed. Rep. of Germany . | |
| 0073577 | 6/1980 | Japan | 400/146 |
| 0073578 | 6/1980 | Japan | 400/146 |
| 2026392 | 2/1980 | United Kingdom | 400/154.4 |

OTHER PUBLICATIONS

IBM Technical Disclosure Bulletin, "Rolling Contact Strip Printer", Kambic, vol. 19, No. 12, May 1977, pp. 4691–4692.

*Primary Examiner*—Ernest T. Wright, Jr.
*Attorney, Agent, or Firm*—Albert L. Sessler, Jr.

[57] ABSTRACT

A printing apparatus is provided which utilizes rolling pressure contact for printing, and includes a plurality of sets of serially arranged character elements mounted for movement on the external surface of a printing drum. Movement of the sets to place a desired character into printing position is accomplished by controlling the speed of a motor driving a pulley connected by cable to a given character set, relative to the speed of a motor driving the printing drum in rotational movement.

15 Claims, 16 Drawing Figures

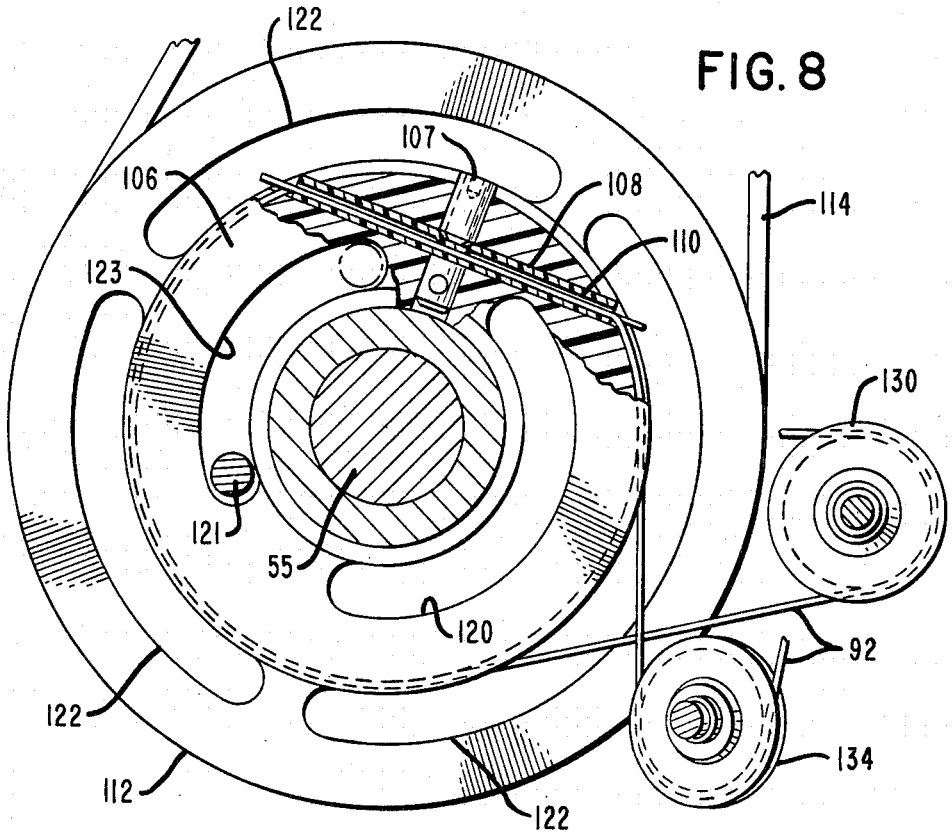
FIG. 8
FIG. 2
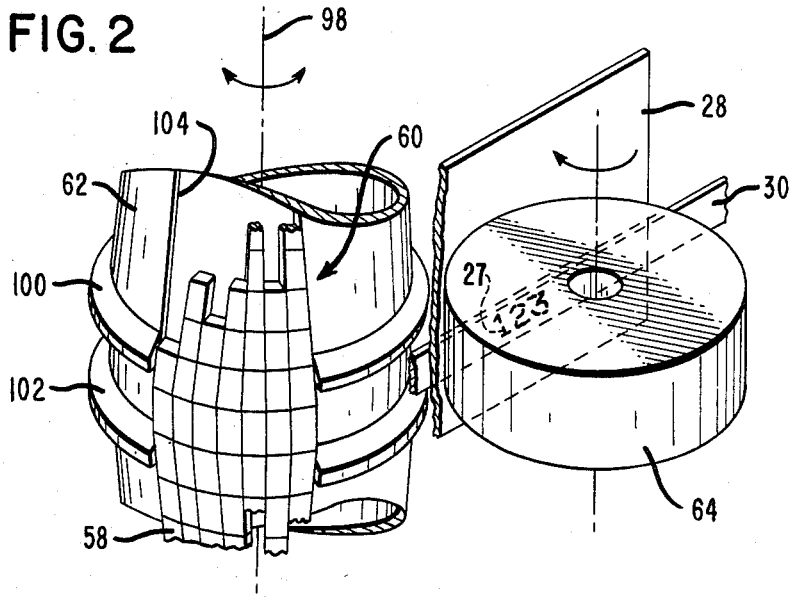

DATA
CONTROL
MICRO COMPUTER
COMPARATOR LOGIC
D/A
ERROR AMP
POWER AMP
LOGIC LOCK
FILTER AND AMP
TACH
FILTER AND AMP
PHASE DETECTOR
+V
OE1
OE2
M
M
244
246
204
202
197
245
241
238
239
220
199
201
218
222
180
226
224
240
230
232
228
200
237
192
194
196
118
190
198
236
188
186
206
119
214
182
212
210
207
208
209
35
184
234
34

CHARACTER SET PRINTING MEANS UTILIZING ROLLING PRESSURE CONTACT FOR PRINTING

BACKGROUND OF THE INVENTION

In record media processing machines in which different operations such as reading, sorting and encoding of documents are done on the same machine, the speed of the document being processed must often decrease at the printing station because conventional printers are not capable of matching processing speeds which can be attained by other modules of the machine. An additional transport mechanism may therefore be employed to adjust the document speed, first to the slower printer speed, and then to the normal speed of the machine. This speed variation limits the machine throughput and is a major cause of document jam and edge damage. Also, in order to produce a good quality, high resolution print, such as defined by ABA Standard for E-13B, impact printing with full face characters is normally used. This produces a high acoustical noise level.

A detailed description of the E-13B magnetic ink character recognition font may be found in the "American National Standard Print Specifications for Magnetic Ink Character Recognition" published by American National Standards Institute, Inc., 1430 Broadway, New York, N.Y. 10018.

A typical printer employed in a financial item processing machine may be an impact printer comprising two banks of hammers, placed on the same line. The hammers carry a complete set of full face characters. During a printing operation, a document moves at a constant speed in front of the hammer banks. A hammer having a character symbol "X", for example, will strike to provide an impression of "X" on the document whenever the appropriate location for an "X" in the message, as determined beforehand, appears in the proper position with respect to the hammer bearing the "X" character. In other words, the proper time for the firing of each hammer in such an apparatus is a function of the location of each particular character, as well as a function of the paper speed and position. This dependency makes the control of hammer firing more complex. Furthermore, the speed of the document through the printer is limited by the short contact time between the hammer and the document, as determined by print character smearing, and also by the cycle time of the hammer in the worst-case situation in which a hammer must strike two or more times consecutively. All of these considerations affect the throughput speed of the machine.

SUMMARY OF THE INVENTION

The present invention relates to a printing device which utilizes rolling pressure contact for printing, rather than impact, and which thereby overcomes the disadvantages described above in connection with printing devices of the impact type.

A printing device constructed in accordance with the present invention is capable of printing noninterrupted lines, by printing one character serially in line after another in the same order in which the characters appear in the printed message. Each print character is dynamically positioned to a printing line as the structure supporting the print character continues to rotate, and the character selection procedure is the same for all characters.

As printing is accomplished by contact pressure rather than by impact, a lower noise level is achieved. A further advantage of the machine of the present invention is that its speed can be changed continuously and that the speed of the printing apparatus can be synchronized easily to the normal speed of the paper through the apparatus, thereby decreasing the tendency of the paper to jam and to incur edge damage. A further advantage is that because of the rolling contact rather than the impact contact of impact printing, and particularly because of the low inertia design of the positioning system for the characters, the machine of the present invention is capable of high throughput. An additional advantage is that the tolerance and spacing of the characters is defined by the geometry of the design and does not affect the printing speed.

In accordance with one embodiment of the invention, a printer for recording data on a medium comprises rotatable print character support means having a printing position on the surface thereof; drive means for driving said support means in rotational movement; platen means positioned cooperative relationship to said support means and rotatable in a direction opposite to the direction of rotation of said supporting means to effect rolling contact pressure printing; at least one character set mounted for movement with respect to the outer surface of said support means, said character set comprising a plurality of character elements; positioning means for moving each character set individually as the support means rotates to place a predetermined character at the printing position of the support means; and means for controlling the operation of the printing means.

An object of the present invention is to provide an improved printing apparatus.

A further object is to provide a printing apparatus which utilizes rolling pressure contact for printing.

Another object is to provide a printing apparatus comprising a plurality of print character sets which are mounted on a rotating support element and which are selectively positioned for printing as the support element continues to rotate.

Another object is to provide a printing apparatus capable of relatively high speed which can be changed continuously if desired.

With these and other objects, which will become apparent from the following description, in view, the invention includes certain novel features of construction and combinations of parts, a preferred form or embodiment of which is hereinafter described with reference to the drawings which accompany and form a part of this specification.

BRIEF DESCRIPTION OF THE DRAWINGS

FIG. 2 is a partial perspective view showing the cooperation of the printing drum, the various print character sets thereon, the locating rings on the drum, and the pressure roller.

FIG. 8 is a sectional view taken along line 8—8 of FIG. 3.

DESCRIPTION OF THE PREFERRED EMBODIMENT

Figure 1:
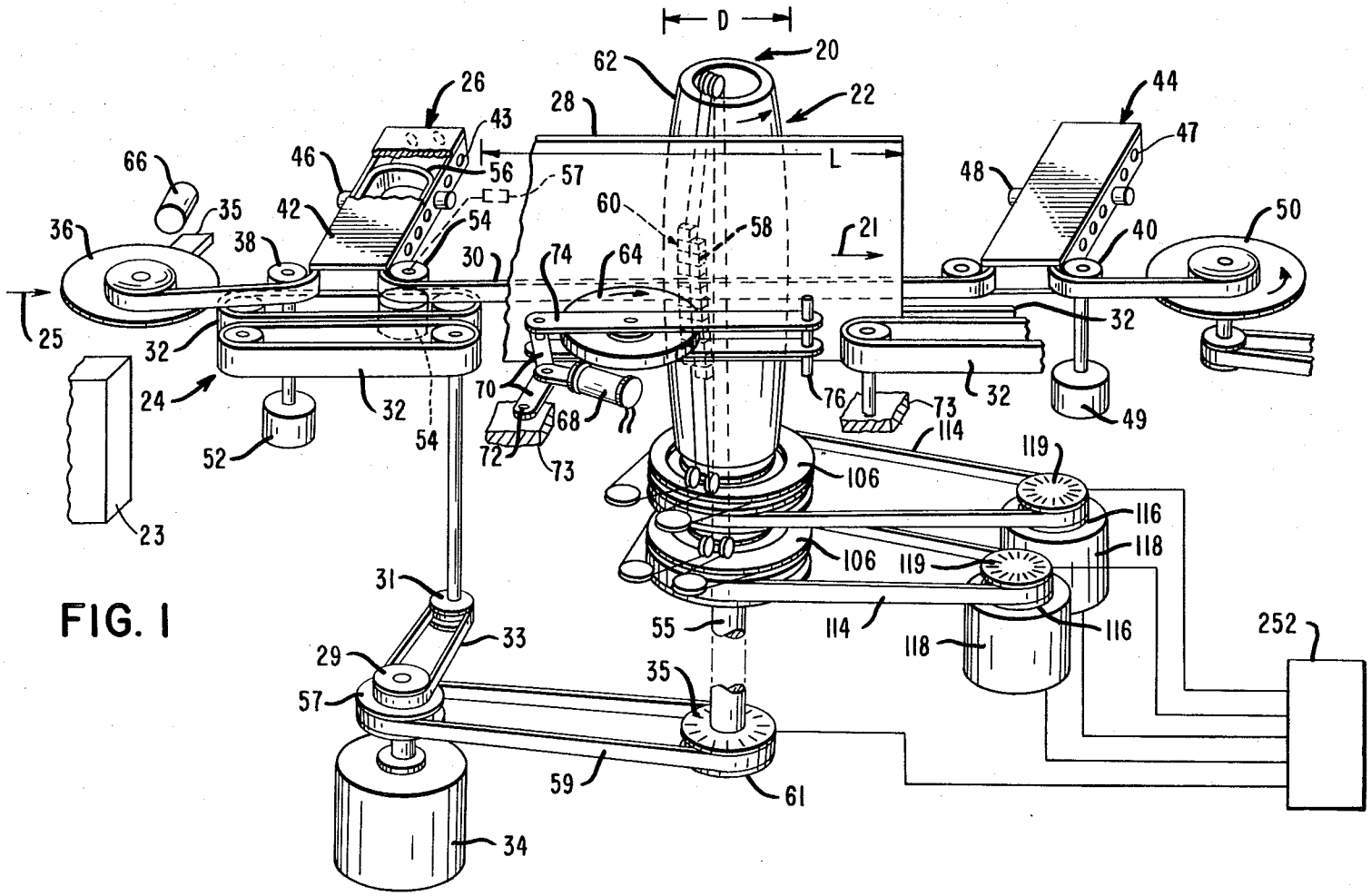
FIG. 1 is a perspective view of the printing apparatus of the present invention, also showing the document drive means and the ribbon supply and take-up means.

Referring now to FIG. 1 of the drawings, the roll printer 20 comprises a printing unit 22, a paper transport unit 24 and a ribbon drive unit 26. In the roll printer 20, a record medium 28, which may for example be a check upon which magnetic ink character recognition information is to be printed, is brought into the printing unit 22 by the paper transport unit 24. The printing unit 22 transfers ink from a ribbon 30 to the record medium 28. The ink may, for example, be in the form of a dry powder coated on said ribbon 30. The ribbon drive unit 26 ensures that fresh ribbon 30 is fed properly into the printing unit 22 and that the used portion of said ribbon 30 is removed from said printing unit 22. Attached to the printing unit 22 is a hopper 23, which feeds the checks or other record media 28, one by one, to the transport unit 24, in the direction represented by the arrow 25. This feeding is done in synchronization with the operation of the paper transport unit 24 and the printing unit 22.

The paper transport unit 24 comprises a number of belts 32 located both upstream and downstream of the record media flow, with respect to the printing unit 22. The check or other record medium 28 is gripped between each pair of belts 32 and is transported by said belts 32 at a uniform speed in a direction represented by the arrow 21, continuing in the same direction as the arrow 25. In order to ensure that the record media 28 have the same speed as the speed of the printing unit 22, the belts 32 are driven by a printer synchronous motor 34 via a system which includes pulleys 29 and 31 and a drive belt 33.

The ribbon drive unit 26 includes a supply reel 36, two motor-driven capstans 38 and 40, two tape accumulator vacuum columns 42 and 44 having ribbon sensors 46 and 48, respectively, associated therewith, and finally a pick-up reel 50 on which the used ribbon 30 is collected. Fresh ribbon 30 is supplied by the reel 36 to the accumulator 42 by the action of the capstan 38 driven by the motor 52. The accumulator 42 is provided with apertures 43 around the peripheral walls to cause the ribbon 30 to be pulled into the cavity of said accumulator 42 by a controlled vacuum. This action, combined with the supply of ribbon 30 provided by the capstan 38, causes the ribbon loop 56 to expand within the accumulator 42. This loop expansion continues until the loop 56 covers the location of the position sensor 46. At that time, under control of the sensor 46, the motor 52 is switched off so that the supply of ribbon 30 to the accumulator 42 is terminated for the time being.

During the printing operation, the pinch rollers 54, under control of an activator 57, such as a solenoid, are opened to release the ribbon 30 to be drawn into the printing unit 22 for usage. At any other time, the pinch rollers 54 are clamped to fix the forward end of the loop 56 and thereby prevent such loop 56 from being pulled back by the vacuum. As printing progresses, the size of the ribbon loop 56 decreases until it uncovers the position sensor 46. This causes the motor 52 to be activated once more so that new ribbon 30 is supplied to the accumulator 42. The supply reel 36 is equipped with a friction pad 35 in order to maintain tension on the ribbon 30 at all times.

The collection of used ribbon 30, by winding on the reel 50, is similar to that of the feeding operation, except that it occurs in reverse. Used ribbon 30 exits from the printing unit 22 and is fed into the accumulator 44. Said accumulator 44 is equipped with the position sensor 48 and apertures 47 around the periphery thereof, similar to the accumulator 42, so that vacuum is created in the accumulator 44. The position sensor 48 is coupled to a motor 49 to drive the capstan 40. This provides a control for the ribbon loop size in the cavity of the accumulator 44. The ribbon 30 is fed from the accumulator 44 to the pickup reel 50, which is driven through a frictional engagement.

In the printing unit 22, the amount field 27 (FIG. 2) on the check 28, for example, is printed with E-13B characters by pressing and rolling the ribbon 30 and the record medium 28 between a plurality of character beads, or elements, 58, in character sets 60 which are supported by a printing drum 62, and a pressure roller 64.

One printing cycle of the apparatus is required for printing each check or other record medium 28, and a complete rotation of the drum 62 corresponds to a printing cycle. Thus the diameter D of the printing drum 62 at its largest cross-section, where printing takes place, is given by the equation $D \geqq L_{max}/2\pi$, where $L_{max}$ is the maximum length of the check or other record medium 28. The printing drum 62 is fixed to a shaft 55 and is driven by the synchronous motor 34 acting through a pulley 57, a belt 59 and a pulley 61 fixed to the shaft 55.

An optical encoder 35 is fixed on the shaft 55 and provides information concerning angular position and rotational speed of the motor 34 and the shaft 55.

Figure 3:
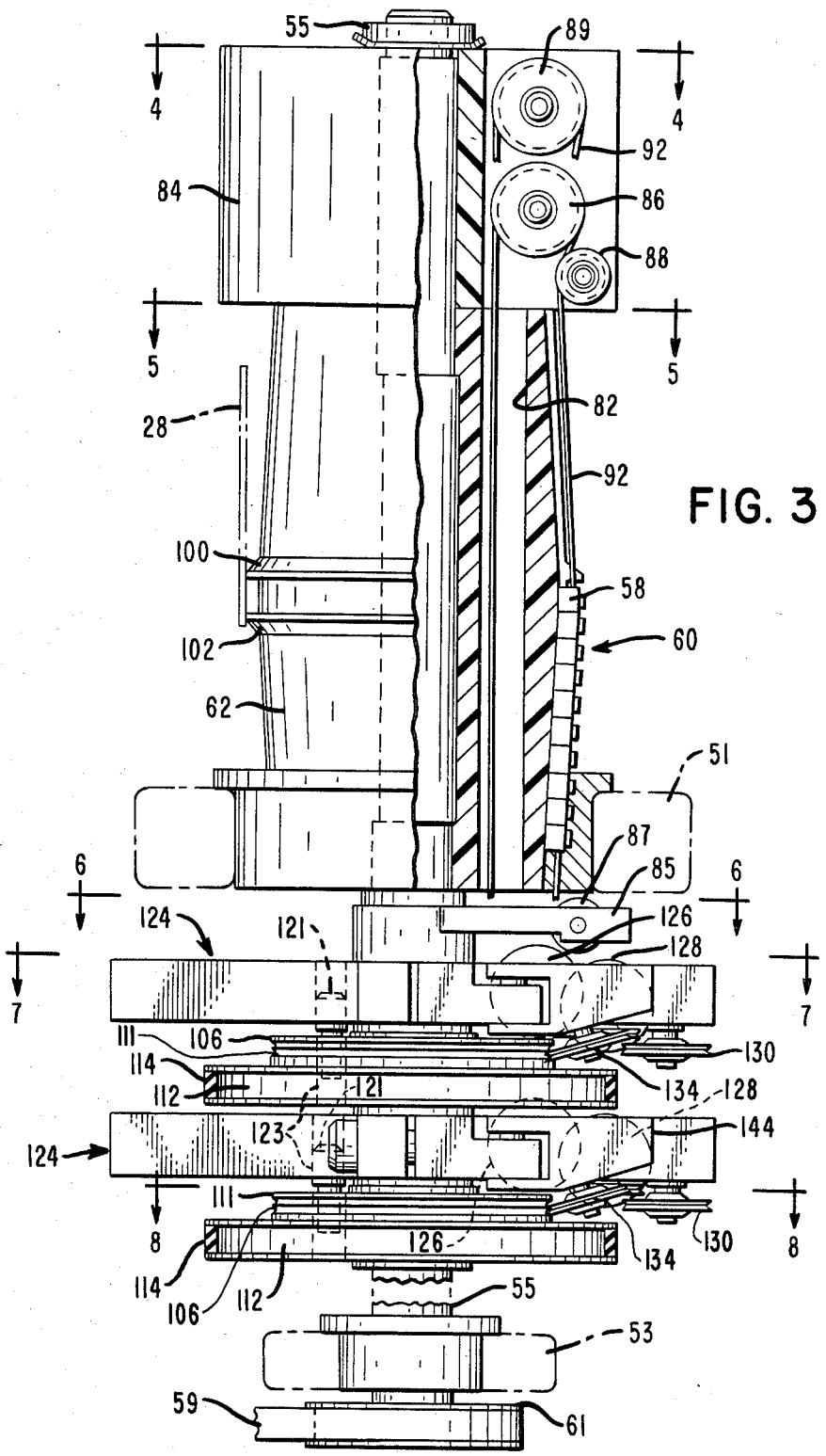
FIG. 3 is an elevation view, partially in section, of one embodiment of the printing apparatus of the present invention.
Figure 4:
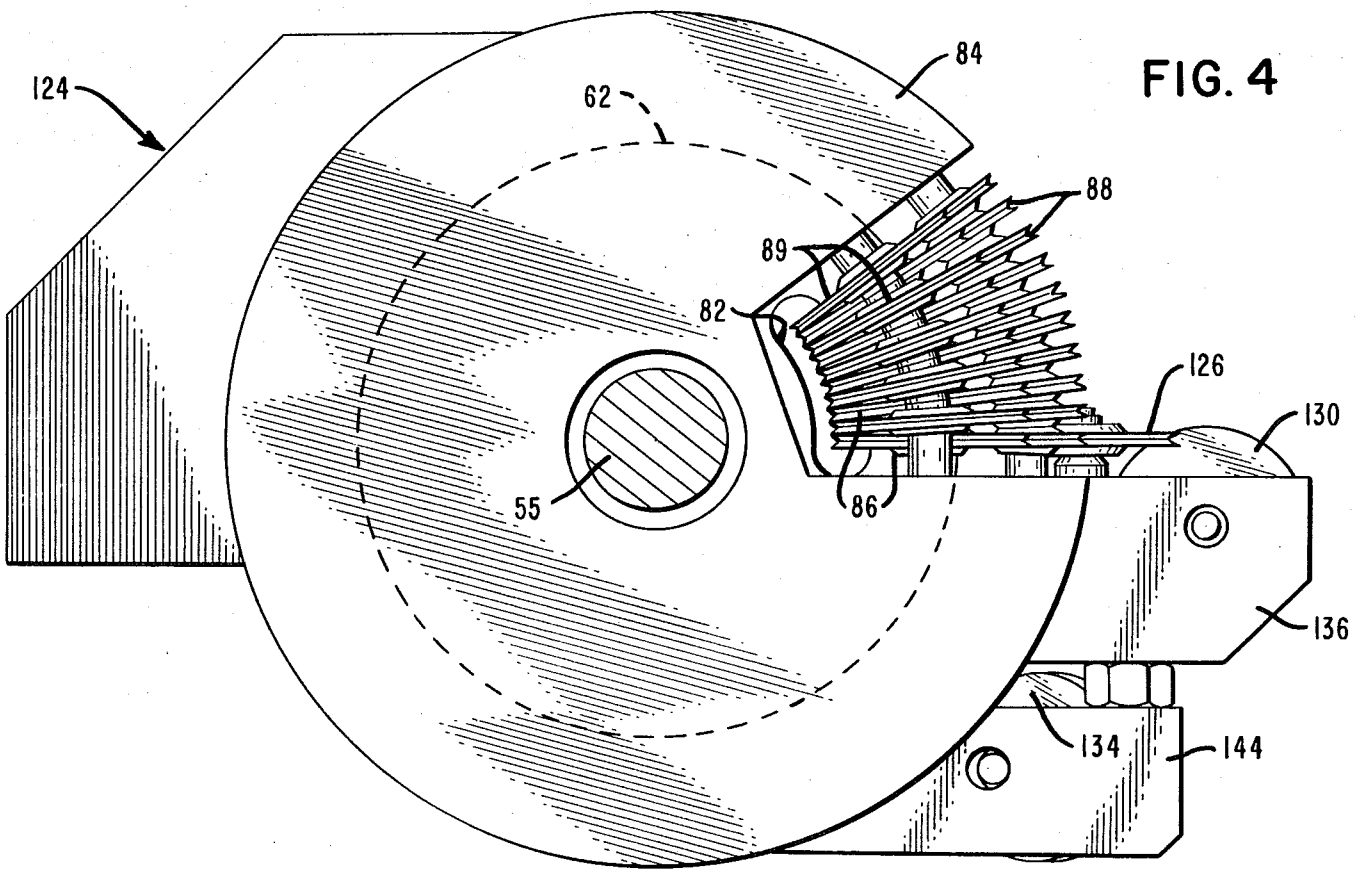
FIG. 4 is a sectional view taken along line 4—4 of FIG. 3.
Figure 5:
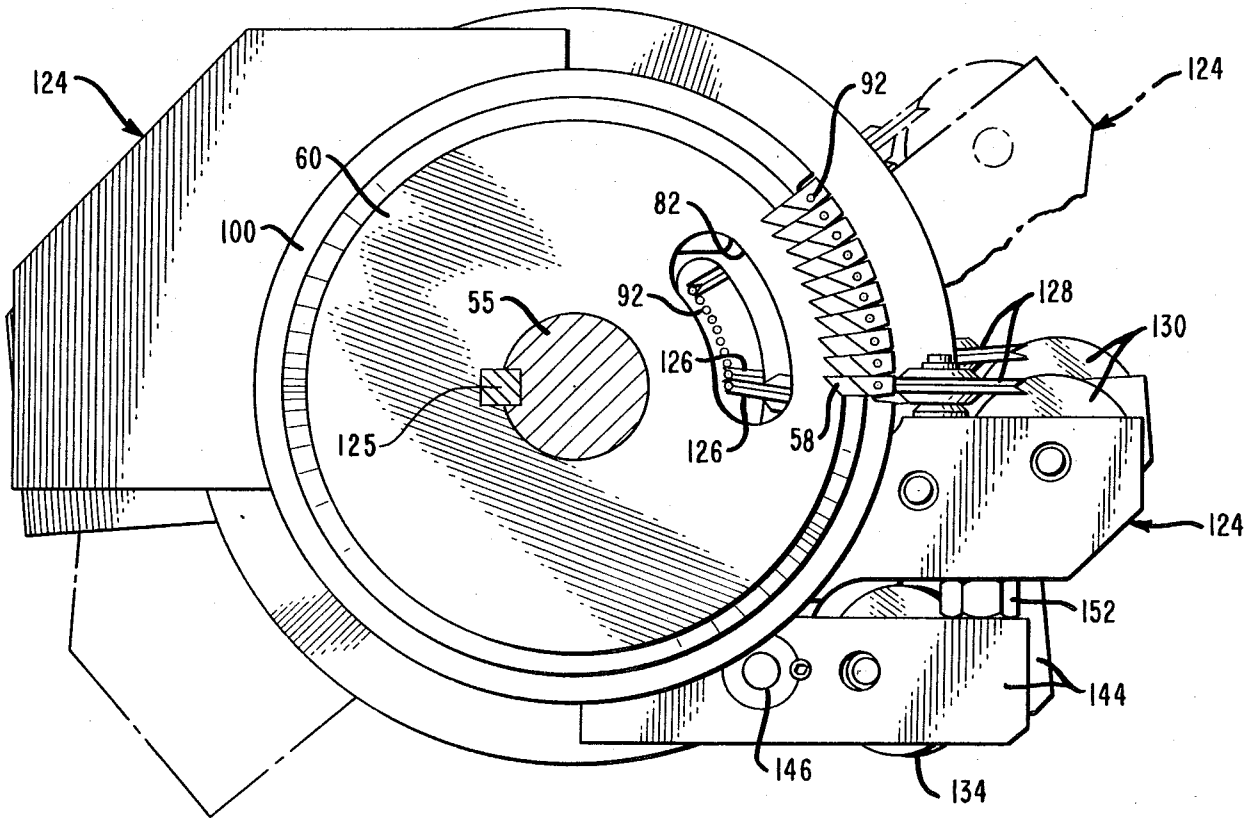
FIG. 5 is a sectional view taken along line 5—5 of FIG. 3.
Figure 6:
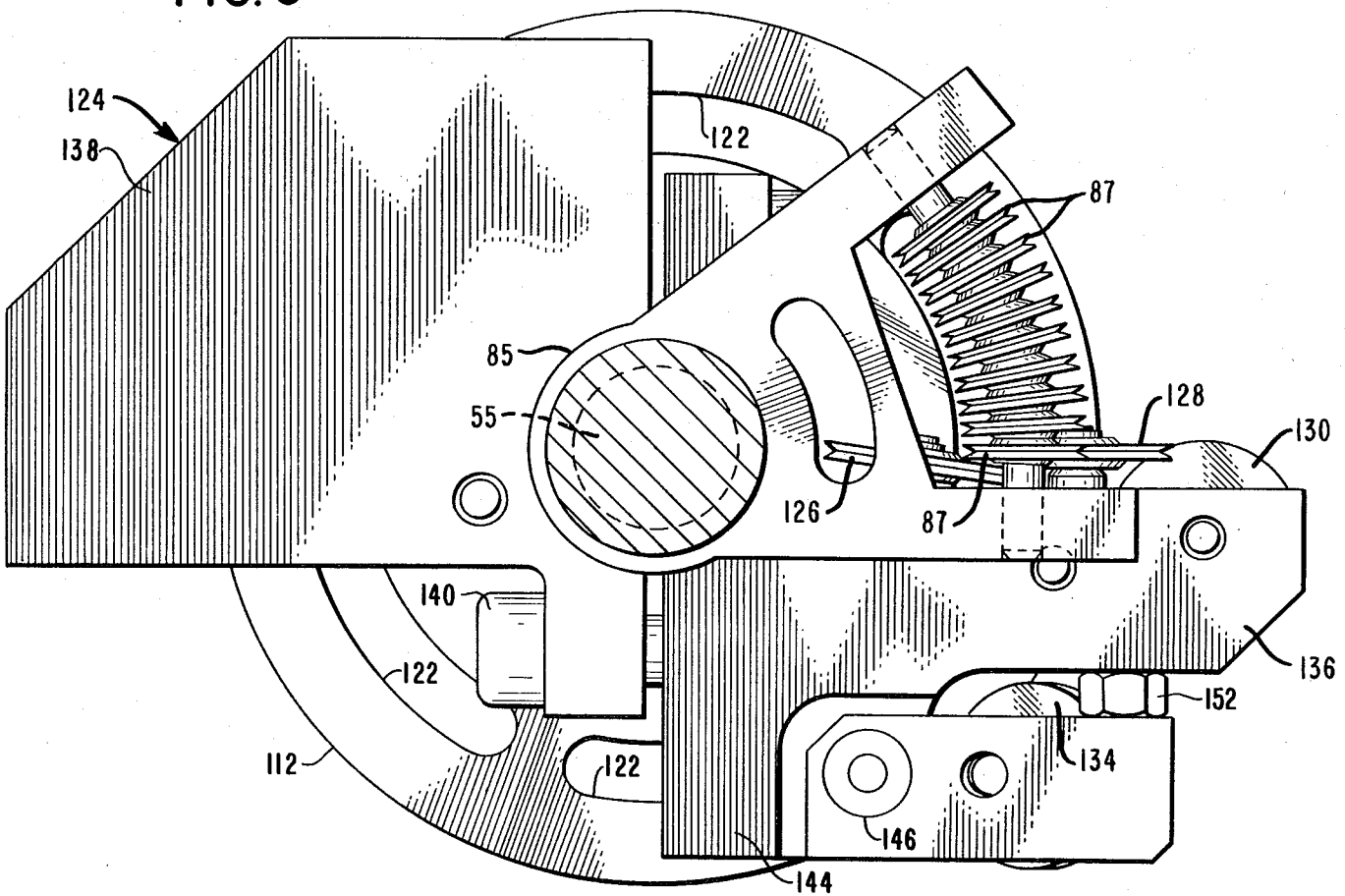
FIG. 6 is a sectional view taken along line 6—6 of FIG. 3.
Figure 7:
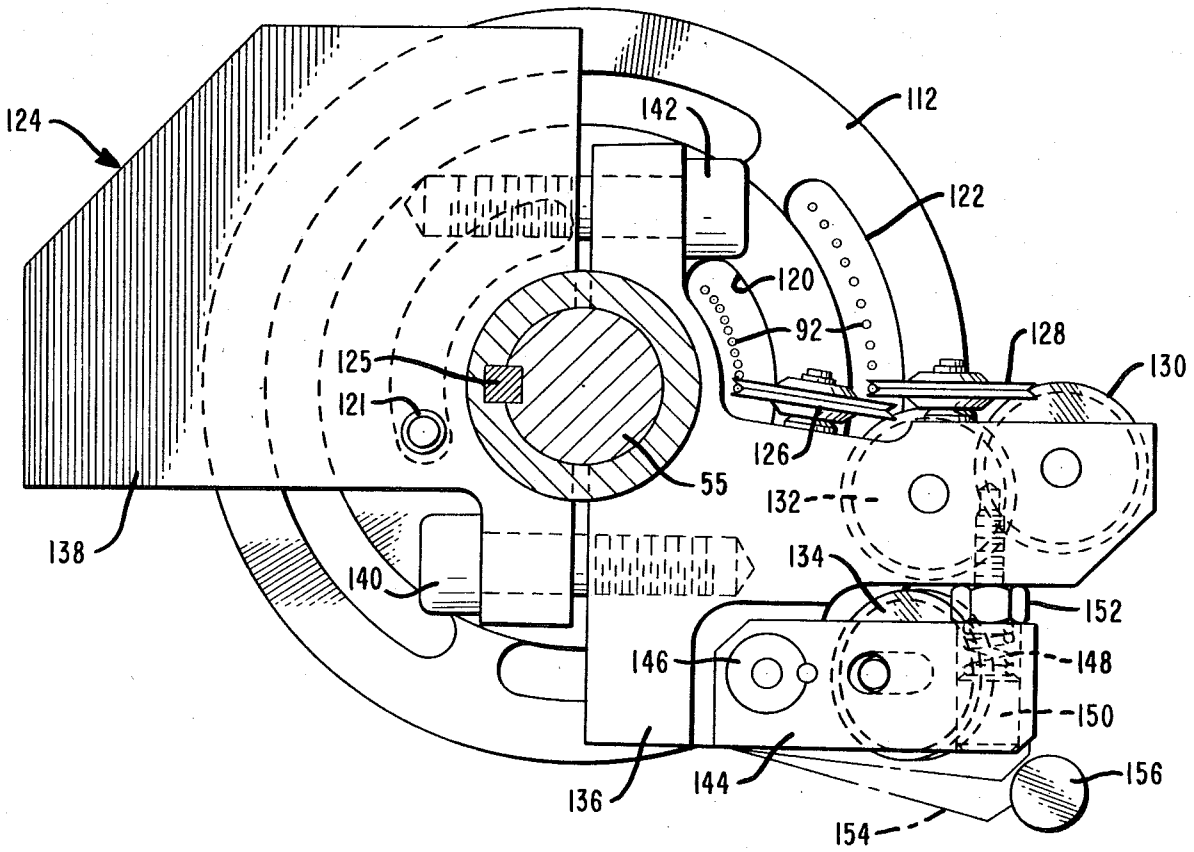
FIG. 7 is a sectional view taken along line 7—7 of FIG. 3.
Figure 9:
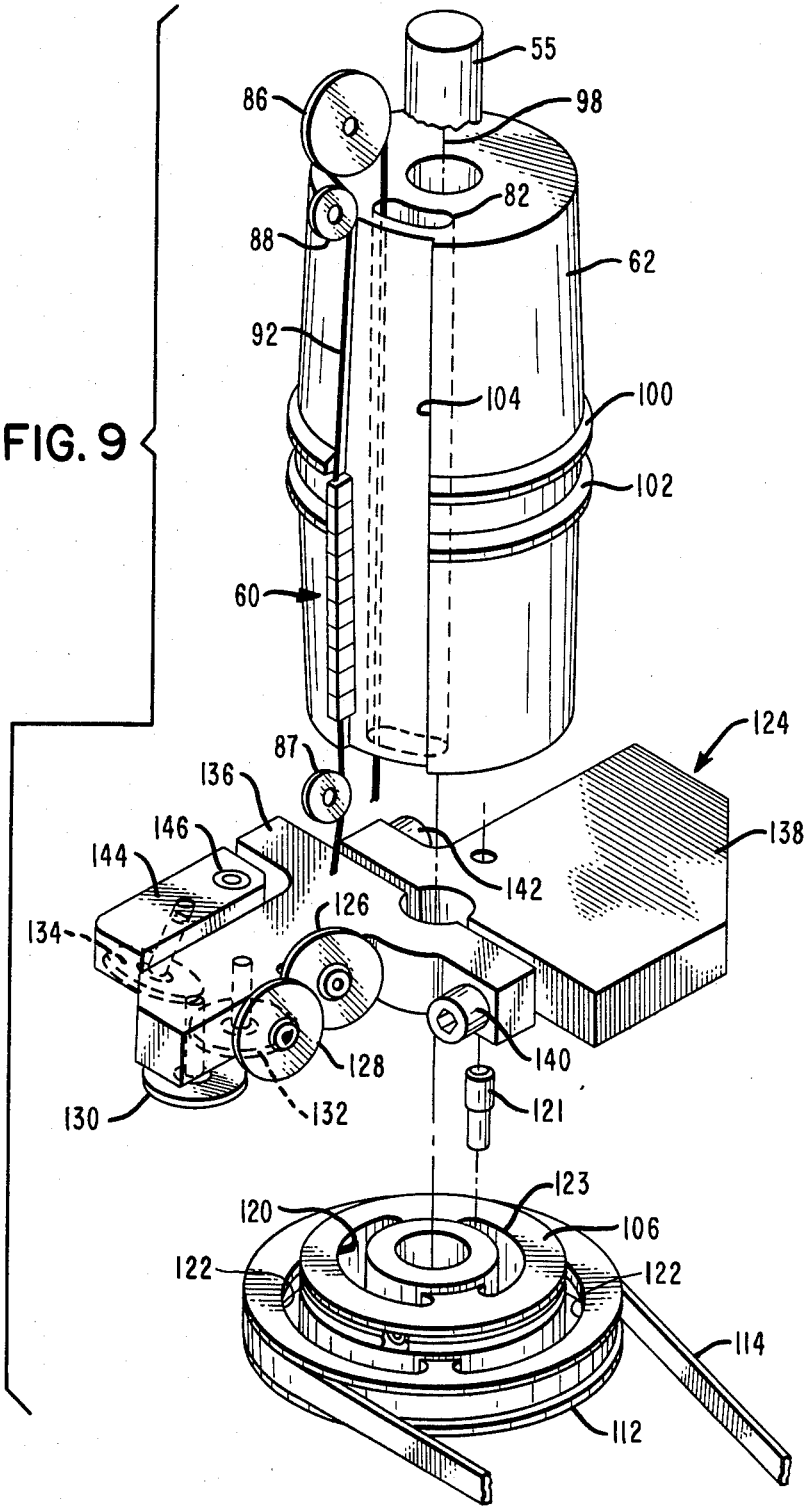
FIG. 9 is a partial perspective view of the printing apparatus, particularly showing the lower frame member which supports the lower cable pulleys.

The drum 62 cooperates with the pressure roller 64 to move the check or other record medium 28 at a speed which is the same as the paper transport speed provided by the interacting belts 32. The shaft 55 is mounted in the machine framework by two bearings 51 and 53 (FIG. 3). The record medium 28 (FIG. 1) may pass through the printing unit 22 in one of two modes: a printing mode or a non-printing mode. If the printing mode is selected, a document sensor 66 senses the presence of a record medium 28 in order to activate a double acting activator 68, which may take the form of a solenoid, for example, and which functions to straighten a pair of toggle links 70 which have one pivoted end 72 connected to the frame 73 of the printing unit 22, with the other end of said pivoted link set connected to a lever 74. The lever 74 supports the pressure roller 64, and is connected at its other end to the frame 73 by shaft 76. The straightening of the links 70 causes the pressure roller 64 to press against the printing drum 62 with the record medium 28 and ribbon 30 captured and squeezed therebetween.

If the non-printing mode is selected, the activator 68 is not energized and the toggle links 70 remain in an unactivated position, so that the pressure roller 64 is positioned to leave an open space between itself and the printing drum 62 so that record media 28 may pass between said drum 62 and said roller 64 without printing taking place thereon.

As is also shown in FIGS. 2–7 inclusive, the printing drum 62 has an interior opening 82 extending therethrough. An upper cap 84 is fixed to the top of the drum 62, and to the shaft 55. The cap 84 provides mounting means for a plurality of sets of pulleys 86, 88 and 89, 88 corresponding to the number of columns of information to be printed on a record medium 28 by the printing apparatus, as will subsequently be described in greater detail. Pulleys 86 and 89 are identical and serve the same function. They are staggered in location in order to provide a more compact arrangement. Similarly, a lower cap 85 is fixed to the shaft 55 adjacent to the bottom of the drum 62 and provides the mounting means for a plurality of lower guide pulleys 87, one for each column of information to be printed on a record medium 28.

Figure 11:
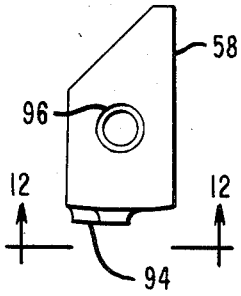
FIG. 11 is a plan view of a printing element which may be used in the printing apparatus of the present invention.
Figure 12:
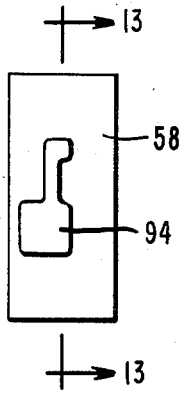
FIG. 12 is an end view taken along line 12—12 of FIG. 11.
Figure 13:
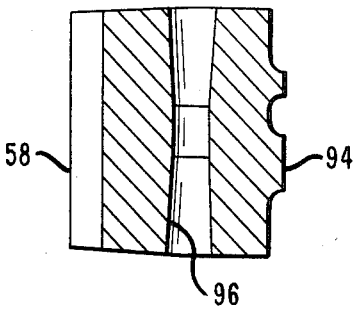
FIG. 13 is a sectional view taken along line 13—13 of FIG. 12.

The printing drum 62 carries a plurality of "bead chains" or character sets 60 thereon, each set being made up of a plurality of individual character beads or elements 58, which are shown in greater detail in FIGS. 11, 12 and 13, and which are strung on a cable 92. Each element 58 of a character set 60 includes a type face 94 of an E-13B character "1", for example, thereon, and is provided with a bore 96 therethrough to receive the cable 92 on which the individual elements 58 are fixed immovably in a serial fashion, by crimping or other suitable means. The number of beads or elements 58 included in a given character set 60 will vary in accordance with the application for which the printer 20 is employed, and typically may include the numerals 0–9 inclusive, together with any symbols necessary, such as those used for encoding MICR (magnetic ink character recognition) information on checks.

A plurality of character sets 60 are mounted on the drum 62, so as to be generally aligned with each other and with the axis of rotation 98 of the drum 62, as shown, for example, in FIG. 2. Rings 100 and 102, which are positioned on the drum 62 to provide surfaces for engaging the roll 64, are interrupted along their periphery to receive the character sets 60, which are positioned in a recessed portion 104 of the drum 62.

As best shown in FIG. 8, the ends of each cable 92 are anchored in a member 106 which is positioned on the shaft 55 and is rotatable with respect thereto. One member 106 is provided for each character set 60. Anchoring of both ends of the cable 92 may be by any suitable means, such as by a plastic retainer 108 which is located in a bore 110 of the member 106. A set screw 107 or other suitable means may be employed to crimp the retainer 108 and secure both of the cable ends against movement. The circumference of the member 106 is grooved in a double groove configuration 111 (FIG. 3) to receive the cable 92. A pulley 112 is secured to the member 106 to rotate therewith about the shaft 55 and is connected by a belt 114 and a further pulley 116 to a driving motor 118 (FIG. 1) to be rotated thereby.

An optical encoder 119 is coupled to the motor 118 and provides information concerning the angular position and rotational speed of the motor 118 and the member 106. A cut-out portion 120 in the member 106 (FIG. 8) and the pulley 112 as well as second cut-out portions 122 in the pulley 112 are provided to enable the cables 92 for the various character sets to pass therethrough without interference. As best shown in FIGS. 3, 5, 7 and 9, a lower frame member 124 is fixed to the shaft 55, by any suitable means such as a key 125, adjacent to each member 106. One lower frame member 124 is provided for each character set 60. Each lower frame member 124 rotatably mounts a set of lower guide pulleys 126, 128, 130, 132 and 134, around which the cable 92 for the corresponding character set 60 is arranged to cause movement of said character set 60 in a predetermined manner, as will be subsequently described in greater detail. A runaway prevention pin 121 extends downward from each frame member 124 and coacts with a slot 123 in the corresponding member 106 to limit movement of the member 106 in the event of drift of the member 106 in the event of malfunction of its motor 118 (FIG. 1). This prevents possible damage to the cable 92 and the elements 58 of the character set 60.

Each frame member 124 includes two elements 136 and 138, bolted together by fasteners 140 and 142. An additional element 144 is pivotally mounted by shaft 146 on the element 136 and provides a bearing means for the pulley 134. The element 144 is urged in a clockwise direction as viewed in FIG. 7 by a spring 148 which is positioned in a recess 150. This arrangement functions to maintain the desired degree of tension in the cable 92, which may be adjusted by an adjusting nut 152. A surface 154 on the element 144 cooperates with a detector represented schematically by the circle 156 to provide an indication of breakage of a cable 92 if the element 144 swings far enough in a clockwise direction under urging of the spring 148 to interact with the detector 156, which detector 156 may be of any suitable type, such as an electrical switch or a light beam which can be interrupted by the element 144.

Figure 10:
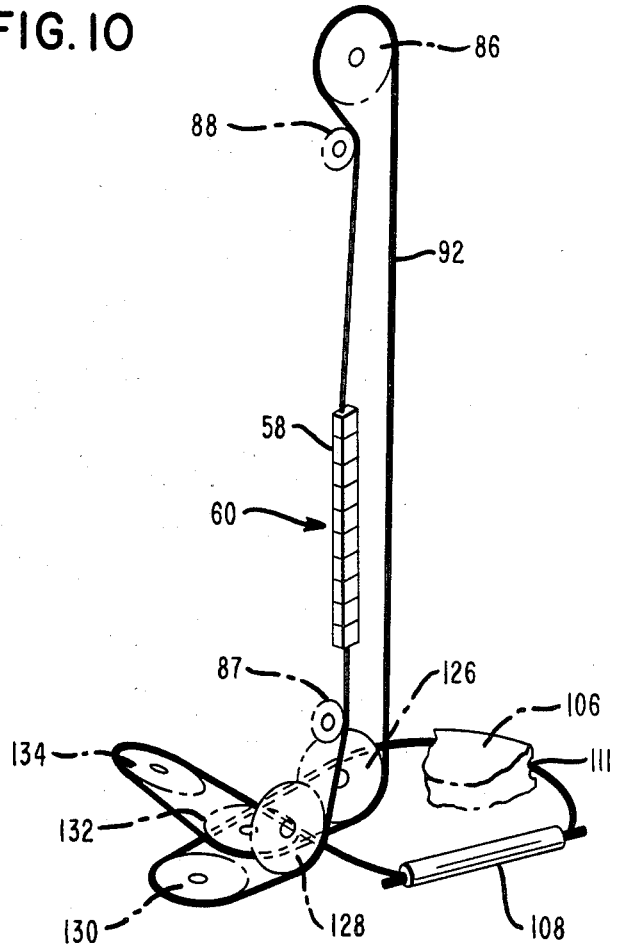
FIG. 10 is a perspective view showing the path of movement of the cable associated with a character set.

As best shown in FIG. 10, from one end which is secured in the retainer 108 of the member 106, the cable 92 for each character set 60 extends around the pulleys 134, 132 and 126 on the frame member 124 (FIGS. 9 and 10), upward through the interior aperture 82 in the drum 62, around the upper pulleys 86 and 88, through the various elements 58 (to each of which said cable 92 is secured) of the character set 60, around the lower pulley 87, around the pulleys 128 and 130 on the frame member 124, around the member 106 in the grooves 111 thereof, and back to the retainer 108 to which the other end of said cable 92 is secured.

Relative movement of the character set 60 with respect to the drum 62 for positioning of a predetermined character element 58 in printing position is accomplished by rotational movement of the member 106 for that character set 60 with respect to the drum 62, which causes movement of the cable 92, thereby altering the location of the character set 60 on the drum 62. This is normally done while both the drum 62 and the member 106 are rotating, and is accomplished by imparting a differential rotational velocity (either positive or negative) to the member 106. It will be recalled that each member 106 is secured to a pulley 112 which is rotated through the belt 114 by the driving motor 118.

Figure 14:
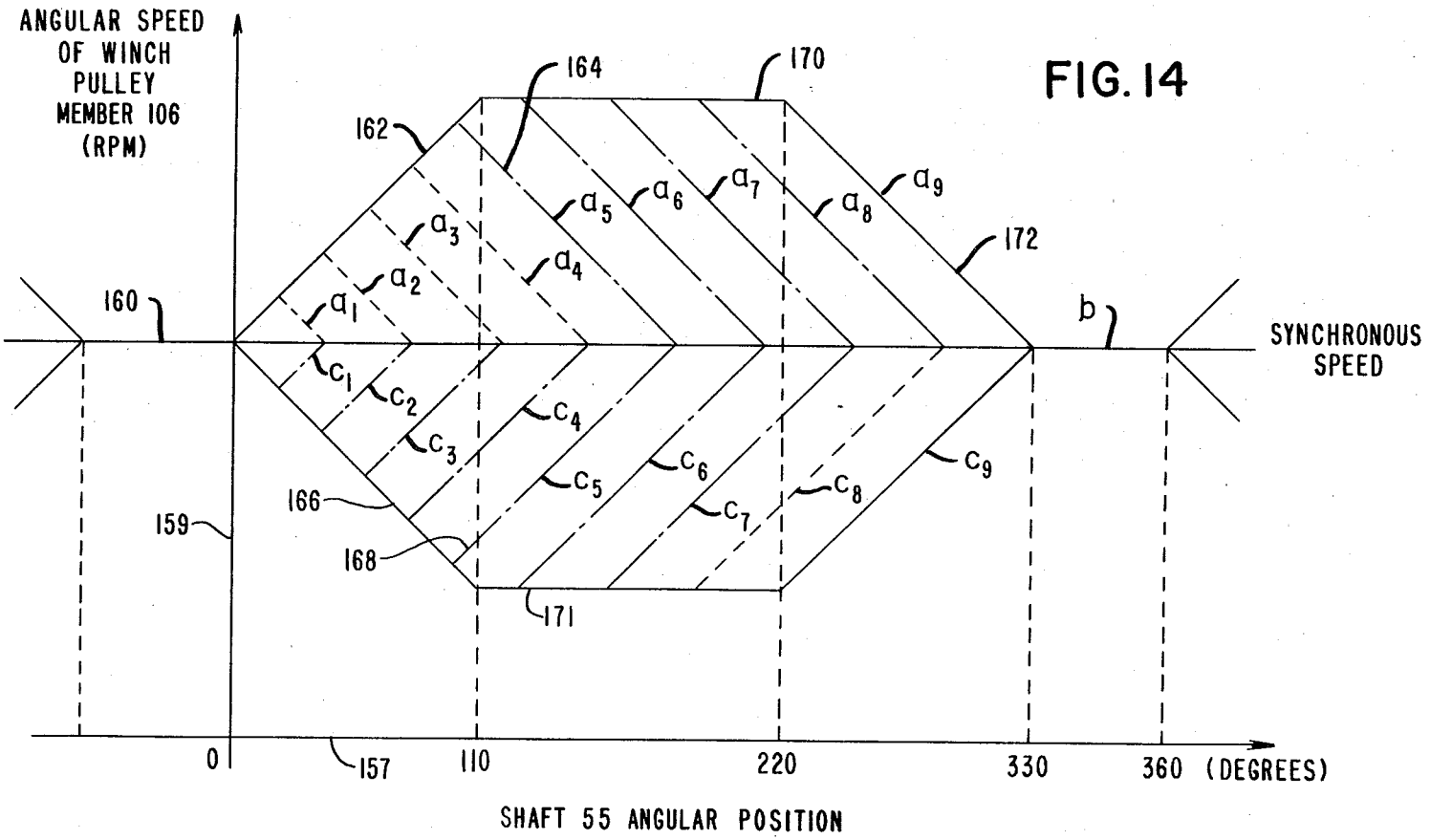
FIG. 14 is a velocity diagram showing the relative velocities required for movement of printing elements of the print character sets into printing position.

The manner in which the relative speeds of the drum 62 and the member 106 are combined to produce the desired movement of the character set 60 is graphically shown in FIG. 14, in which the main shaft angular position is represented on the horizontal axis 157, and the angular speeds of the drum 62 and the member 106 are represented on the vertical axis 159. The normal rotational speed of the drum 62 is represented by the line 160. This speed is constant, and will be termed synchronous speed. When the rotational speed of the member 106 is also at synchronous speed, there is no relative movement between the character set 60 and the drum 62.

It may thus be seen that in order to shift the relative position of the character set 60 with respect to the drum 62, in order to position a different character element 58 at the printing position, it is necessary to change the relative rotational speed of the member 106 with respect to the rotational speed of the drum 62. FIG. 14 illustrates this. For example, in order to shift the character set 60 the equivalent of five printing positions in a first direction, with respect to the drum 62, the member 106 is accelerated from the synchronous speed at which it is rotating, by accelerating the motor 118, at a rate represented by the line 162 in FIG. 14. At a predetermined time, the member 106 is then decelerated, as may be accomplished by altering the input to the motor 118, at a rate represented by the line 164, also designated "a5", from the group of lines a1 to a9, representing the number of positions moved, until the member 106 returns to synchronous speed as represented by line 160. The net result of this acceleration and deceleration is to move the character set 60 five positions with respect to the drum 62. Movement of five positions in the opposite direction may be achieved by first decelerating the member 160 and then accelerating it, as represented by lines 166 and 168, line 168 being also designated "c5", from the group of lines c1 to c9, representing the number of positions moved, in FIG. 14. It will be noted that for a large incremental movement of the character set 60 comprising six to nine positions in the first direction, the member 106 is first accelerated as represented by line 162 to a predetermined velocity, then maintained at that constant velocity, as represented by the line 170, for a predetermined length of time, and then decelerated to synchronous speed, as represented by a line 172 (also designated "a9") for a nine-position movement. Similarly, for a large incremental movement of this character set 60 in the second direction, the member 106 is first decelerated as represented by line 166 to a predetermined constant velocity represented by line 171 for a predetermined length of time and then accelerated to synchronous speed as represented by line C9 for a nine-position movement.

A significant advantage of the present invention over prior art structures is that these printing position movements of the various character sets 60 are accomplished smoothly and dynamically during rotation of the drum 62, with the member 106 associated with a given character set 60 being at synchronous speed as the given character element 58 is rotated into printing position.

Figure 15:
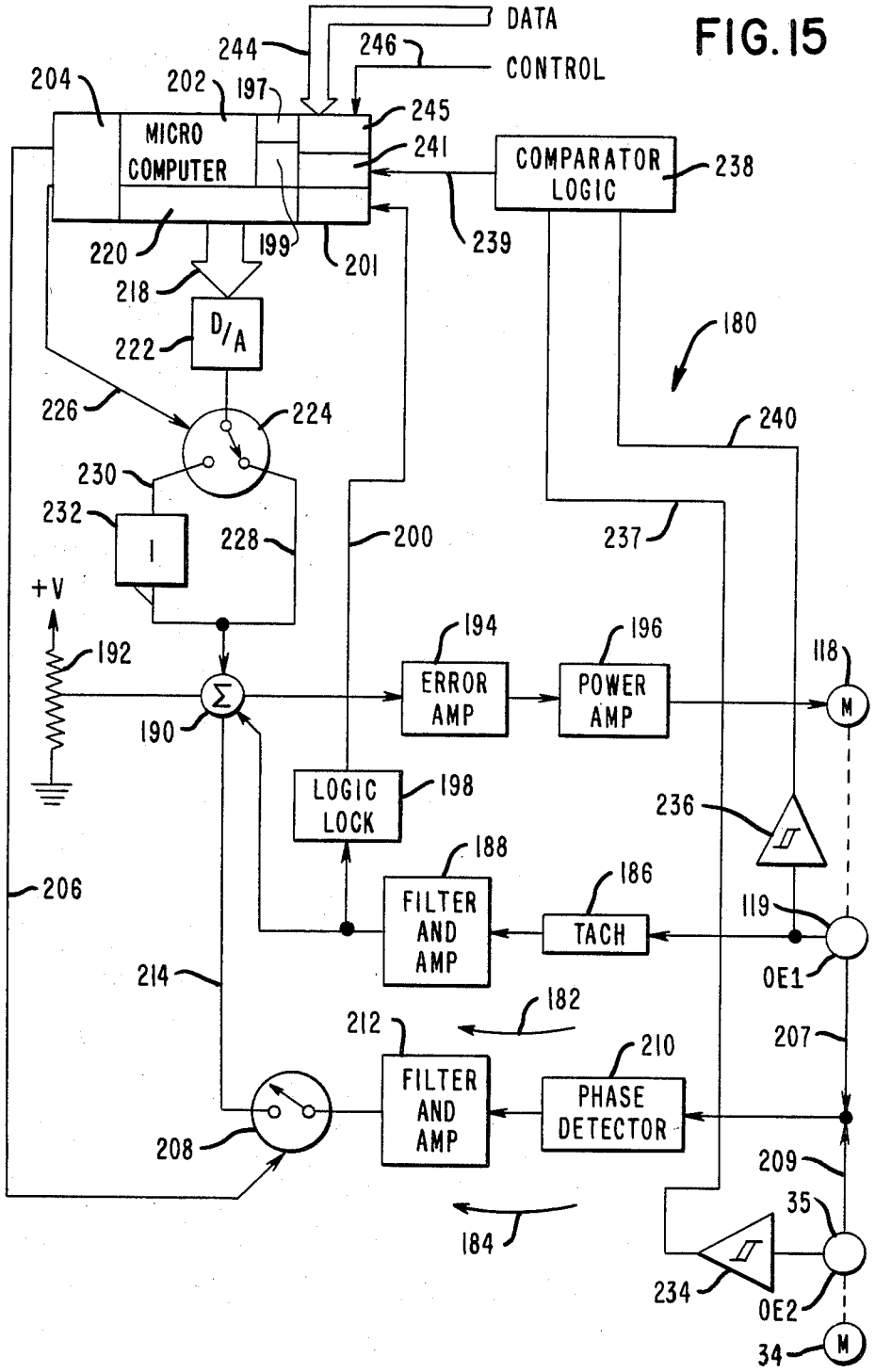
FIG. 15. is a circuit diagram showing the control logic circuitry for controlling a drive motor for positioning a print character set.

A circuit 180 for controlling the operation of the D.C. motor 118 which drives each of the members 106 is shown in FIG. 15. One such circuit 180 is provided for each motor 118. In broad terms, the circuit 180 may be considered to include two feedback loops: a velocity loop 182 and a position loop 184. The velocity loop 182 is used to effect large changes in rotational velocity of the motor 118, for example, on the initial acceleration or deceleration required for movement of a character set 60, while the position loop 184 is used for small changes in position of the character set 60, as for example when said character set 60 has completed the greater portion of its predetermined movement for a given printing operation, and a final minor adjustment in position is required.

The velocity loop 182 includes a tachometer 186, which may, for example, comprise an L290 tachometer chip, manufactured by SGS-ATES, Milano, Italy, and a filter and amplifier circuit 188, which may, for example, comprise a low pass RC (resistor-capacitor) filter in combination with a low DC offset operational amplifier such as a National LF411A manufactured by National Semiconductor Corporation, Santa Clara, Calif., and which produces a signal which is derived from the optical encoder 119, and which is proportional to the speed of the motor 118.

Each of the optical encoders 35 and 119 may be a Renco model R2000, manufactured by Electrocraft Corporation, Minneapolis, Minn. Each optical encoder 35 and 119 provides three outputs: a TTL index, comprising one pulse per revolution, and two sine wave quadrature output signals, an A phase signal and a B phase signal.

Signals from the two optical encoders 35 and 119 are shaped by the Schmitt triggers 234 and 236, which may be of type 74LS14 manufactured by National Semiconductor Corporation. These signals are transmitted over conductors 237 and 240, respectively, to a comparator logic circuit 238, which may comprise two cascaded 4-bit counters, such as 74LS193 counters, manufactured by National Semiconductor Corporation. This circuit 238 is connected so that A phase pulses from one of the optical encoders 35 or 119 squared by Schmitt trigger 234 cause the counter to count in one direction, while A phase pulses from the other of said counters squared by Schmitt trigger 236 cause it to count in the opposite direction. The processor 202, to which the comparator logic circuit 238 is connected by a conductor 239 which is applied to a port 241 of the microprocessor 202, utilizes the net count information from the comparator logic circuit 238 to alter a speed word which is provided to the digital to analog converter 222, so that the DC motor 118 will again change its speed, by reducing speed if it had previously increased speed, and vice versa, to return to its synchronous speed, once the desired phase of the motor 118 with respect to the motor 34 is attained.

A summing circuit 190, which customarily takes the form of a junction of resistors on each joining conductor, compares the signal produced by the tachometer 186 with a reference signal established by the setting of a speed set circuit 192, which comprises a variable resistor, having a maximum resistance of, for example, 5000 ohms, having one end connected to a base reference potential, shown here as ground, and having the other end connected to a source of positive potential of appropriate magnitude, such as 12 volts, to produce an error signal. This error signal is processed by an error amplifier 194, which may take the form of an operational amplifier such as a National Lf411A manufactured by the National Semiconductor Corporation, and by a power amplifier 196, and is used to drive the DC motor 118. The power amplifier 196 may be any suitable amplifier, such as the FA9000 manufactured by Electrocraft Corporation, Minneapolis, Minn., capable of supplying the necessary current to the motor 118 employed and having appropriate feedbacks to supply a constant current to the motor 118 regardless of velocity for velocities which are less than 4000 rpm.

The setting of the set speed circuit 192 determines the synchronous speed of the motor 118. This synchronous speed differs from the synchronous speed of the synchronous motor 34 which is used to drive the drum 62, by a constant multiplier which is equal to the drive ratio of the belt drive system which includes the belt 114 and the pulley 116.

Once the velocity of the DC motor 118 comes within 5% of the synchronous speed of the motor 34, a lock signal, such as a "logic 1" output, is generated by the logic lock circuit 198, which may comprise a pair of operational amplifiers such as LN311 amplifiers manufactured by National Semiconductor Corporation. This signal is sent by conductor 200 to a port 201 of the microprocessor 202, which may be of type 8051 manufactured by Intel Corporation, Santa Clara, Calif.

The microprocessor 202 controls the circuit 180, and in this instance it recognizes the signal from the logic lock 198 and sends a control signal through its port 204 via a conductor 206 to a switch 208, which may be of type TL191 manufactured by Texas Instruments Incorporated, to cause said switch 208 to close, thereby phase locking motors 34 and 118 and causing the position loop 184 to be rendered effective in controlling the speed of the motor 118. At this point, the character set 60 is stationary, but is not in a proper position for printing.

A phase difference between the A phase output pulses of the two optical encoders 35 and 119 (also designated OE2 and OE1, respectively), associated with the motors 34 and 118 respectively, produces an output signal at the summing junction 190 which forces the motor 118 to adjust its speed. A phase detector 210 and a filter and amplifier circuit 212 in the position loop 184 process the signals taken from the optical encoders 35 and 119 on conductors 207 and 209. The resulting signal is then applied through the switch 208 and a conductor 214 to the summing junction 190. The phase detector 210 produces an output signal which is proportional to the phase difference between the motors 34 and 118, and may be of type No. AD532JD, manufactured by Analog Devices, Norwood, Mass.; and the filter and amplifier circuit 212 may comprise a low pass RC filter and a low DC offset operational amplifier such as Model LF411A, manufactured by National Semiconductor Corporation. Synchronization of the motor 118 with the motor 34 results in the character set 60 being held stationary with respect to the printing drum 62.

After initial power up or reset of the system, once the motors 34 and 118 are locked in phase, the character set 60 must first move to a predetermined home position with respect to the printing drum 62. The TTL index pulse from both optical encoders 35 and 119 must be coincident in order for the character "zero" to be in home or initial position. In order to make these index pulses coincident, the number of A phase pulses or counts from the optical encoder 119 occurring between the TTL pulses from the optical encoders 35 and 119 is first counted by the comparator logic circuit 238. Because of the mechanical constraint which includes the pin 121 and the slot 123, this number will be less than 30, and the phase of the index pulse of optical encoder 35 will lag the phase of the index pulse of optical encoder 119. The motor 34 must therefore be speeded up and return to synchronous speed to move the necessary number of A phase counts to cause its index pulse from optical encoder 35 to be coincident with the index pulse from optical encoder 119.

From home position, a desired character element 58 in the character set 60 is positioned for printing by moving the character set 60 so that the desired character element 58 is on the printing line. This is accomplished by loading a number, representative of the character to be positioned, into the microprocessor 202 via data bus 244. The microprocessor 202 by reference to a look-up table 197 in memory (RAM) 199, correlates this number with the number of counts required to place the new character element 58 in the correct printing position.

A 5-bit code, representative of the required motor speed, hereinafter designated as the speed word, is placed on the data lines 218 which are connected to port 220 of the microprocessor 202. This signal is converted from digital to analog form by a digital to analog circuit 222, which may be of type DAC0831, manufactured by National Semiconductor Corporation. The resulting analog signal is transmitted through a switch 224, which may be of type TL191 manufactured by Texas Instruments Incorporated. The polarity of the signal is controlled by the microprocessor 202 through a conductor 226 which causes the signal to be transmitted over either a first branch 228, or a second branch 230 containing an inverter 232 which may be of type 74LS04 manufactured by National Semiconductor Corporation, to the summing junction 190. From the junction 190, the signal is applied through the error amplifier 194 and the power amplifier 196 to the motor 118 to produce the desired alteration in its speed. Polarity selection by the switch 224 enables the speed of the motor 118 to be either increased or decreased, depending upon the positioning movement desired for the corresponding character set 60.

It may be seen that in order to move the character set 60 from one printing position to another, the microprocessor 202 generates a different speed word in response to an external command applied over the data bus 244 and through a port 245 associated with the microprocessor 202. In the illustrated embodiment, it is contemplated that each character element 58 of the character set 60 is eighteen optical encoder counts from the next, so that, for example, to move the character set 60 eight characters, 144 counts would be required.

When the shaft of the motor 118 has advanced to a predetermined position which is a certain number of counts, say 50, away from its new position, the speed word is progressively reduced, by use of a previously established look-up table 197 associated with the microprocessor 202, so that the motor velocity linearly decreases from high speed back to synchronous speed. Switch 208 is then closed and the movement is complete. If the step to be undertaken is less than 50 counts, the look-up table 197 is entered directly, and the step is automatically performed. This routine is employed to position the character "zero" to its printing position, which is considered to be home, and is also utilized for positioning of all other characters.

Figure 16:
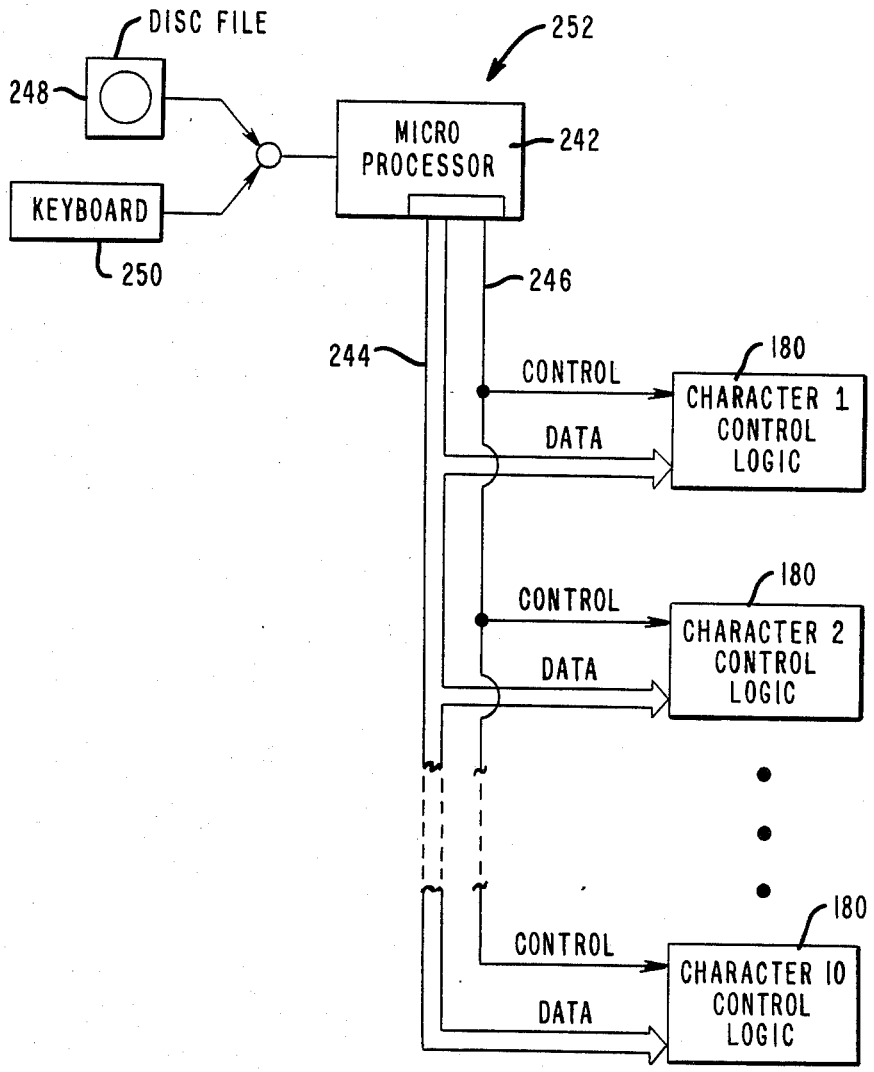
FIG. 16 is a block diagram showing the relationship of the control logic circuitry for the various print character sets of a microprocessor and an associated disk file and keyboard.

Referring now to FIG. 16, it will be seen that the system circuitry 252 includes a plurality of circuits 180, which are provided in the printing apparatus, one for each character set 60. A microprocessor 242, which may be of type 68000, manufactured by Motorola, Inc., Phoenix, Ariz., exercises overall system control, and is connected by the data bus 244 and control lines 246 to the various individual circuits 180. A suitable memory unit 248, which may take the form of a floppy disk manufactured by Shugart Corporation, Sunnyvale, Calif., is coupled to the microprocessor 242, as is a keyboard 250 for providing operator input. The control system of FIG. 16 provides input data to the circuits 180 for positioning their character sets 60; controls the sequence of movement of the character sets 60; initiates the necessary start-up functions; and performs such other control operations as may be required in particular printing applications.

While the form of the invention illustrated and described herein is particularly adapted to fulfill the objects aforesaid, it is to be understood that other and further modifications within the scope of the appended claims may be made without departing from the spirit of the invention.

We claim:

1. A printer for recording data on a medium comprising:

drum means rotatable about its longitudinal axis and having a printing position along a line on its surface defined by an intersection with the surface of a plane perpendicular to said axis;

drive means for driving said drum means in rotational movement around its longitudinal axis;

rotatable roller means positioned adjacent said drum means at said printing position and cooperating with said drum means to effect rolling contact pressure printing;

a plurality of character sets mounted for movement on the outer surface of said drum means in either of two opposite directions, each character set comprising a plurality of individual character elements serially connected to each other;

positioning means for moving each character set individually as the drum means rotates to place a predetermined character of each set at the printing position of the drum means, said positioning means for each character set including a cable which is connected to each character set, a pulley to which the cable is connected, and a positioning motor to drive each pulley; and means for controlling the operation of the positioning means whereby selected characters of each of the character sets are located at the drum means printing position to cooperate with said roller means to effect continuous printing as the drum means rotates, said means for controlling also including first velocity detecting means coupled to the drive means and second velocity detecting means coupled to the positioning motor, and control means coupled to the first and second velocity detecting means for controlling the relative speeds of the positioning motor and the drive means, whereby movement of the character sets with respect to the drum means is accomplished by changing the relative speeds of the positioning motors with respect to the drive means.

2. The printer of claim 1, also including a plurality of pulleys for effecting changes in the paths of movement of the cables for the character sets.

3. The printer of claim 2, in which the drum means is of annular configuration and the paths of said cables extend through the interior of the drum means.

4. The printer of claim 1, in which the control means includes a velocity feedback loop for controlling large changes in velocity of the positioning motor and a position feedback loop for controlling small adjustment changes in velocity of the positioning motor, to cause the positioning motor to operate at a speed bearing a predetermined relationship to the speed of the drive means.

5. The printer of claim 4, in which the velocity feedback loop comprises a tachometer circuit and a filter and amplifier circuit.

6. The printer of claim 4, in which the position feedback loop comprises a phase detector circuit and a filter and amplifier circuit.

7. The printer of claim 4, in which the control means also includes logic lock means for rendering the position feedback loop operative when the positioning motor attains a predetermined fraction of the speed of the drive means.

8. The printer of claim 7, in which the control means also includes a reference speed circuit and a summing means which receives inputs from the velocity feedback loop, the position feedback loop, and the reference speed circuit, and provides a control signal to the positioning motor to control its speed.

9. The printer of claim 8, also including data processing means and a digital-to-analog converter coupled to said summing means to provide a speed change signal to the summing means which is effective to change the speed of the positioning motor and thereby cause movement of the character set with respect to the drum means to bring a different character into printing position.

10. The printer of claim 9, also including switching means controlled by the data processing means to reverse the speed change signal applied to the summing means, and thereby reverse the direction of movement of the character set with respect to the drum means for a given speed change signal.

11. The printer of claim 1, in which said drum means is of generally barrel-shaped configuration, and the plane of the printing position is located at the point of maximum barrel diameter.

12. The printer of claim 11, in which the individual character elements of each character set are flexibly connected to each other for curvilinear longitudinal movement along the surface of the drum means.

13. A printer for recording data on a medium comprising:

rotatable print character support means having a printing position on the surface thereof;

drive means for driving said support means in rotational movement;

at least one character set mounted for movement with respect to the outer surface of said support means, said character set comprising a plurality of character elements;

positioning means including a positioning motor operating at predetermined relative speeds with respect to the drive means for moving each character set individually as the support means rotates to place a predetermined character at the printing position of the support means; and means for controlling the operation of the positioning means.

14. The printer of claim 13, in which the positioning means for each character set includes a cable which is connected to each character set, and a pulley driven by the positioning motor and to which the cable is connected.

15. A printer for recording data on a medium comprising:

rotatable print character support means having a printing position on the surface thereof;

drive means for driving said support means in rotational movement;

at least one character set mounted for movement with respect to the outer surface of said support means, said character set comprising a plurality of character elements;

positioning means including a positioning motor operating at predetermined relative speeds with respect to the drive means for moving each character set individually as the support means rotates to place a predetermined character at the printing position of the support means, said positioning means for each character set including a cable which is connected to each character set, and a pulley driven by the positioning motor and to which the cable is connected; and means for controlling the operation of the positioning means, including first velocity detecting means coupled to the drive means and second velocity detecting means coupled to the positioning motor, and control means coupled to the first and second velocity detecting means for controlling the relative speeds of the positioning motor and the drive means, whereby movement of the character sets with respect to the support means is accomplished by changing the relative speeds of the positioning motors with respect to the drive means.

* * * * *